US011435121B2

(12) United States Patent
Ishiguro

(10) Patent No.: US 11,435,121 B2
(45) Date of Patent: Sep. 6, 2022

(54) OIL MANAGEMENT SYSTEM FOR MULTIPLE COMPRESSORS

(71) Applicant: Daikin Industries, LTD, Osaka (JP)

(72) Inventor: Takaya Ishiguro, St. Louis Park, MN (US)

(73) Assignee: Daikin Industries, Ltd., Osaka (JP)

( * ) Notice: Subject to any disclaimer, the term of this patent is extended or adjusted under 35 U.S.C. 154(b) by 95 days.

(21) Appl. No.: 16/869,367

(22) Filed: May 7, 2020

(65) Prior Publication Data

US 2021/0348807 A1 Nov. 11, 2021

(51) Int. Cl.
*F25B 31/00* (2006.01)
*F25B 43/00* (2006.01)

(52) U.S. Cl.
CPC ..... *F25B 31/004* (2013.01); *F25B 43/00* (2013.01); *F25B 2500/16* (2013.01)

(58) Field of Classification Search
CPC ..... F25B 31/004; F25B 31/002; F25B 43/00; F25B 43/02; F25B 2500/16; F25B 2400/06; F25B 2400/061; F25B 2400/0751
See application file for complete search history.

(56) References Cited

U.S. PATENT DOCUMENTS 6,948,335 B2 * 9/2005 Matsuoka ..... F04B 39/02 62/470
2002/0007639 A1 * 1/2002 Carey ..... F25B 31/004 62/84
2008/0087028 A1 4/2008 Kim et al.
2010/0154465 A1 * 6/2010 Sakae ..... F25B 31/004 62/470
2015/0198357 A1 * 7/2015 Kobayashi ..... F25B 9/002 62/510
2016/0265821 A1 * 9/2016 Kimura ..... F25B 13/00
2020/0132346 A1 * 4/2020 Saunders ..... F25B 1/10

FOREIGN PATENT DOCUMENTS

JP 2001-324230 11/2001
JP 2003-343931 12/2003
JP 2005-283067 A 10/2005

OTHER PUBLICATIONS

The International Search Report for the corresponding international application No. PCT/JP2021/016761, dated Jul. 29, 2021.

* cited by examiner

*Primary Examiner* — Henry T Crenshaw
*Assistant Examiner* — Kamran Tavakoldavani
(74) *Attorney, Agent, or Firm* — Global IP Counselors, LLP

(57) ABSTRACT

A HVAC system refrigeration circuit is provided. Embodiments of the present disclosure relate to a refrigeration circuit configured to balance the oil carryover between multiple compressors using a single refrigeration circuit. Embodiments of the present disclosure allow for the use of one or more inverter compressors and one or more fixed speed compressors. Embodiments of the present disclosure utilize capillary tubes or other flow control methods to balance the oil carryover between multiple compressors.

12 Claims, 5 Drawing Sheets

OIL MANAGEMENT SYSTEM FOR MULTIPLE COMPRESSORS

FIELD OF THE INVENTION

This invention relates generally to compressor operation and efficiency and, in particular to balancing oil carryover between multiple compressors for heating, ventilation, air conditioning, and refrigeration equipment.

BACKGROUND

This section is intended to introduce the reader to various aspects of the art that may be related to various aspects of the presently described embodiments—to help facilitate a better understanding of various aspects of the present embodiments. Accordingly, it should be understood that these statements are to be read in this light, and not as admissions of prior art.

Modern residential and industrial customers expect indoor spaces to be climate controlled. In general, heating, ventilation, and air-conditioning ("HVAC") systems circulate an indoor space's air over low-temperature (for cooling) or high-temperature (for heating) sources, thereby adjusting the indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat.

In a typical system, a fluid refrigerant circulates through a closed loop of tubing that uses compressors and other flow-control devices to manipulate the refrigerant's flow and pressure, causing the refrigerant to cycle between the liquid and gas phases. These phase transitions generally occur within the HVAC's heat exchangers, which are part of the closed loop and designed to transfer heat between the circulating refrigerant and flowing ambient air. This is the foundation of the refrigeration cycle. The heat exchanger where the refrigerant transitions from a gas to a liquid is called the "condenser," and the condensing fluid releases heat to the surrounding environment. The heat exchanger where the refrigerant transitions from liquid to gas is called the "evaporator," and the evaporating refrigerant absorbs heat from the surrounding environment.

The compressor is at the core of most HVAC systems. The compressor is responsible for compressing refrigerant and initiating the refrigeration cycle. In some systems multiple compressors are used to compress refrigerant. The plurality of compressors may include both fixed-speed compressors and variable speed or inverter compressors. In some systems, compressors are lubricated using oil which may partially discharged with the refrigerant. In such systems, the compressed refrigerant and any oil that is carried with the compressed refrigerant is sent to an oil separator. The oil separator separates the compressed refrigerant from any discharged oil. After the oil separator, the compressed refrigerant is discharged to the condenser while the separated oil is diverted through an oil return line from the oil separator to the suction line and then returned to the compressor.

A suction line is typically a tubing that carries refrigerant vapor from an evaporator to a compressor. In systems using multiple compressors, the suction line may have multiple sides or branches which feed refrigerant vapor to the multiple compressors.

Commercial HVAC applications involving multiple compressors may benefit from the use of a single refrigeration circuit. However, this may result in inefficient compressor operation due to unbalanced oil carryover between the multiple compressors. In systems using multiple compressors, each compressor may discharge a different amount of oil along with the compressed refrigerant. In some configurations, this may result in an inappropriate amount of oil being diverted from one compressor to another, thereby resulting in excessive oil carry over and/or bypass loss.

What is needed is a system that efficiently manages oil carry over and reduces bypass loss when multiple compressors are in use.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to a heating, ventilation, air conditioning or refrigeration (HVACR) systems utilizing multiple compressors with a single refrigeration circuit.

Some embodiments comprise one or more inverter compressors in fluid communication with a first oil separator and one or more fixed speed compressors in fluid communication with a second oil separator. Some embodiments comprises a suction line having a first side and second side, wherein the first side of the suction line is configured to supply refrigerant to the one or more inverter compressors and the second side of the suction line is configured to supply refrigerant to the one or more fixed speed compressors; a first oil return line configured to transfer oil from the first oil separator to the second side of the suction line; and a second oil return line wherein the second oil return line is divided to transfer oil from the second oil separator to both the first and second sides of the suction line.

Some embodiments comprise, a first compressor in fluid communication with a first branch of a refrigerant suction line having a first and a second branch, the first compressor also in fluid communication with a first oil discharge pipe; and a second compressor in fluid communication with the second branch of the refrigerant suction line and in fluid communication with a second oil discharge pipe. The second oil discharge pipe configured to transfer oil from the second compressor to the first and second branches of the refrigerant suction line and wherein the first oil discharge pipe is configured to transfer oil from the first compressor to the second branch of the refrigerant suction line.

Some embodiments comprise a low-pressure refrigerant line having a first portion and a second portion, the first and second portions of the low-pressure refrigerant line extending in different directions from a refrigerant inlet point; a first oil discharge line fluidly connecting a first compressor to a first oil separator; a first oil return line connecting the first oil separator to the second portion of the low-pressure refrigerant line through a first capillary tube; a second oil discharge line fluidly connecting a second compressor to a second oil separator, wherein the second oil compressor has a larger oil carryover than the first compressor; and a second oil return line connecting the second oil separator to the first portion of the low-pressure refrigerant line through a second capillary tube and connecting the second oil separator to the second portion of the low-pressure refrigerant line through a third capillary tube, wherein the first and second capillary tubes are configured to allow substantially equal amounts of oil to flow through and wherein the third capillary tube is configured to allow more oil to flow through with respect to the first and second capillary tubes.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Figure 1:
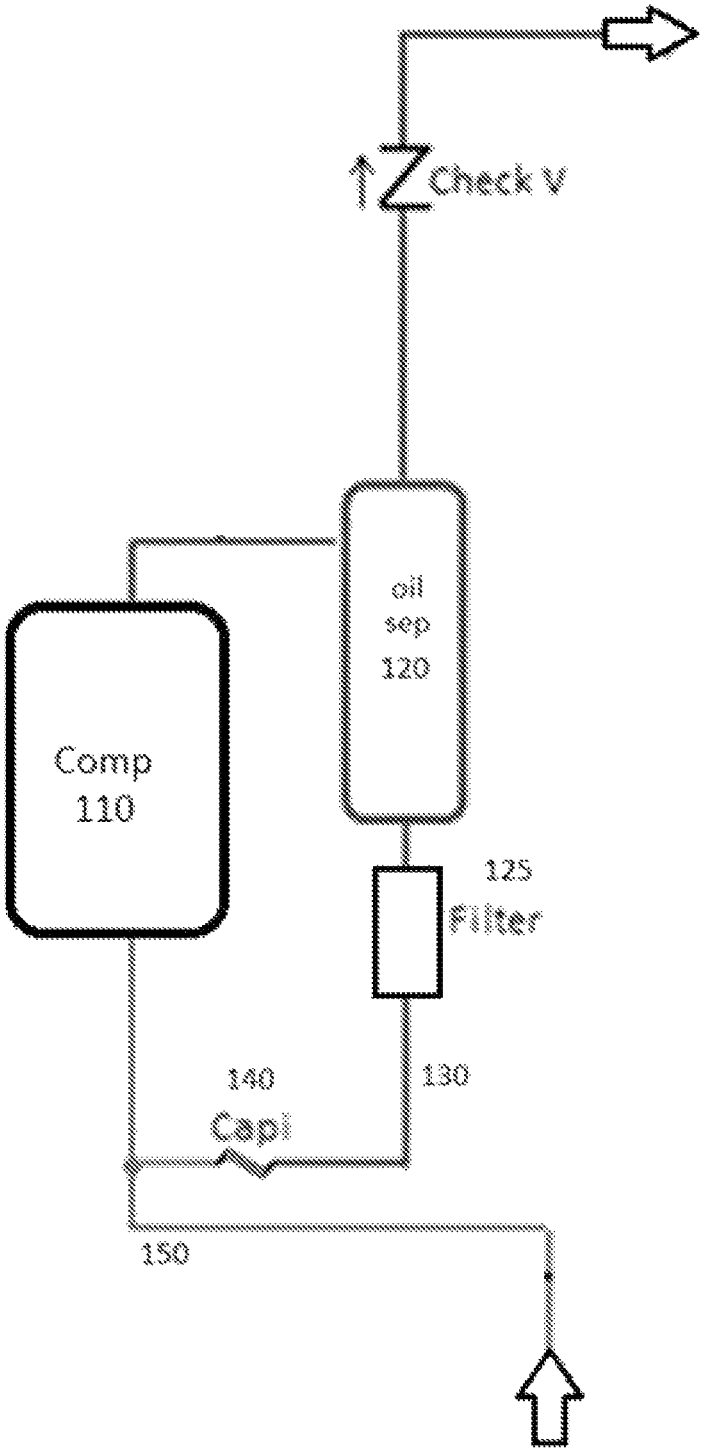
FIG. 1 illustrates schematically an HVAC system with one compressor discharging compressed refrigerant and circulating oil through an oil separator and suction line.

One or more specific embodiments of the present disclosure will be described below. In an effort to provide a concise description of these embodiments, all features of an actual implementation may not be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

In HVAC systems, the compressor typically removes hot, low-pressure refrigerant from an evaporator and compresses the refrigerant to a high-temperature, high-pressure vapor to be discharged to the condenser. Oil is used to lubricate the moving parts of a compressor. Some of this oil is discharged out of the compressor along with the high-pressure refrigerant vapor. In order to maintain the proper amount of oil in the compressor, the oil that is discharged with the refrigerant must be returned to the compressor. The amount of oil that is discharged from the compressor with the high-pressure refrigerant is referred to as oil carryover. When oil carryover is balanced, about same amount of oil that is discharged from the compressor will be returned to the compressor, thereby maintaining the desired oil level in the compressor.

If a compressor is allowed to run out of oil, the moving parts may overheat and/or become damaged. If too much oil is returned to a compressor, the compressor operates less efficiently due, at least in part, to the liquid friction drag created by the compressor components moving through the excess oil.

An oil separator may be used to separate the oil from the high-temperature refrigerant vapor as both oil and refrigerant leave the compressor. The oil separator is placed in the discharge line between the compressor and the condenser. The flow of high-pressure refrigerant slows down in the oil separator, allowing oil droplets to be captured within the oil separator. The heavy oil droplets are separated from the refrigerant vapor and fall to the bottom of the oil separator. The oil collected in the oil separator is returned to the compressor through an oil return line that connects the oil separator to the suction line.

A certain amount of oil is typically maintained at the bottom of the oil separator. If the oil separator runs out of oil, some high-pressure refrigerant vapor may be blown through the oil separator and back into the suction line of the compressor rather than being sent to the condenser. This recirculation of high-temperature, high-pressure refrigerant vapor is referred to a bypass loss and results in a loss of overall system efficiency.

Turning to FIG. 1, the compressor 110 discharges oil, along with high-pressure refrigerant, from the compressor 110 to the oil separator 120. The oil is then separated from the high-pressure refrigerant and falls to the bottom of the oil separator 120. In some embodiments, the oil passes through a filter 125 and then goes to the oil return line 130 before reaching a capillary tube 140 or other flow restriction device. The capillary tube 140 restricts the flow of oil from the oil return line 130 back to the suction line 150. The amount of oil that passes through a capillary tube is determined by the size of the capillary tube. The size of a capillary tube can be used to control the flow rate and pressure drop of a fluid passing through the capillary. Once the oil passes to the suction line 150 it is returned to the compressor 110.

If the oil separator 120 discharges oil to the oil return line 130 faster than it receives oil from the compressor 110, the oil separator 120 may be emptied of oil. In this case, at least a portion of the high-pressure refrigerant vapor would be allowed to pass through the oil separator 120, oil return line 130, and capillary tube 140 and flow into the low-pressure suction line 150. This results in overall reduced system efficiency, as the high-pressure refrigerant that was previously discharged by the compressor has to be compressed again before it can be discharged to the condenser and be used in the refrigeration cycle.

Figure 2:
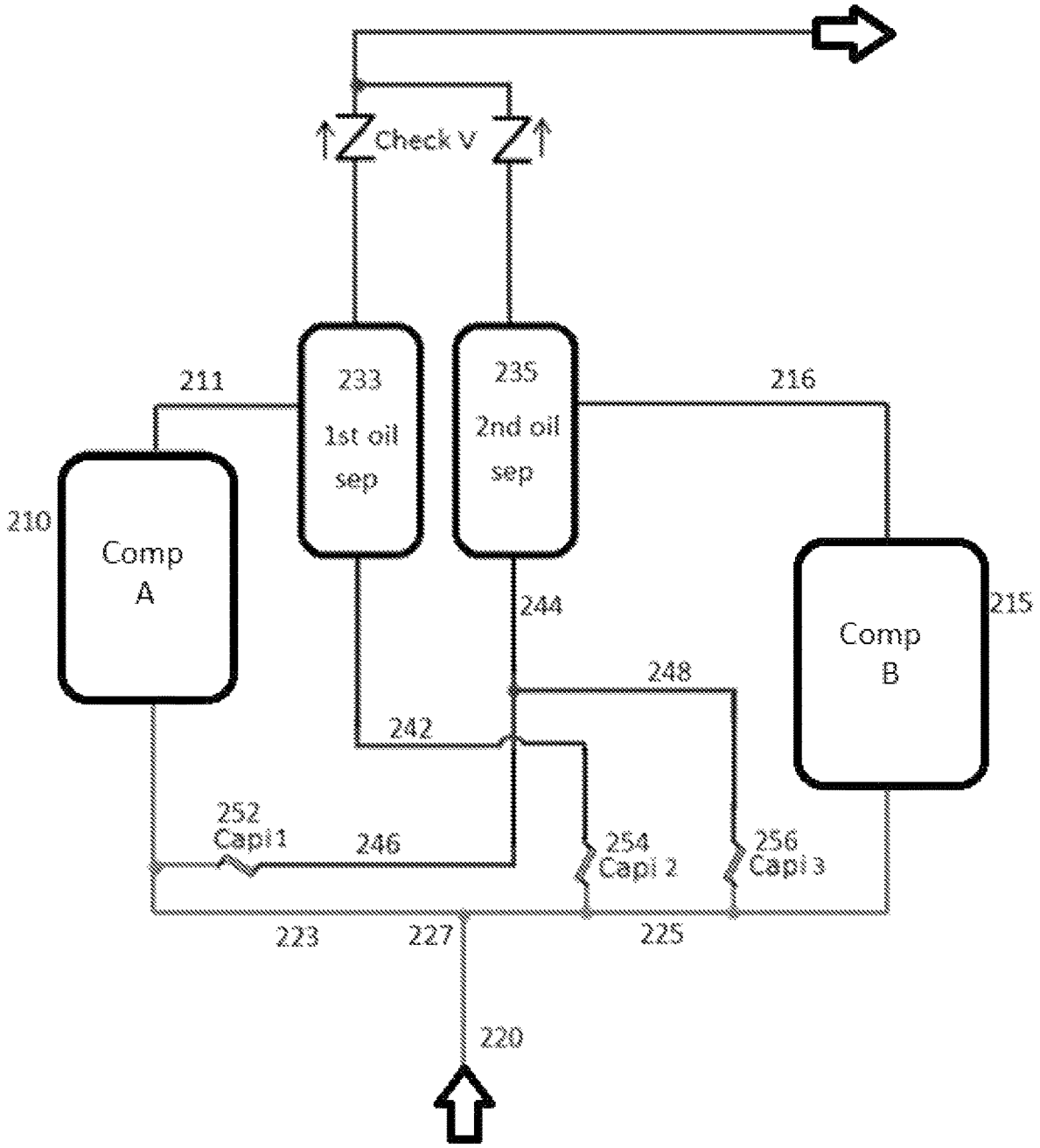
FIG. 2 illustrates schematically an HVAC system with two compressors discharging refrigerant and oil to a first and second oil separator and first or second oil return lines in accordance with the present disclosure.

FIG. 2 shows schematically, an HVAC system in accordance with the present disclosure. In FIG. 2, compressor A 210 is smaller than compressor B 215 and has less oil carryover meaning that compressor A 210 discharges less total oil with the high-pressure refrigerant relative to compressor B 215. Compressor B 215 is larger than compressor A 210 and discharges more oil relative to compressor A 210.

The embodiment illustrated in FIG. 2 includes a first oil discharge line 211 connecting compressor A 210 to the first oil separator 233 and a second oil discharge line 216 connecting compressor B 215 to the second oil separator 235. This embodiment includes a suction line 220 has a first side 223 and a second side 225. In some embodiments, the first side 223 and second side 225 split from a refrigerant inlet point 227. The first oil return line 242 connects the first oil separator to the second side 225 of the suction line 220 through the second capillary tube 254. The second oil return line 244 has a first branch 246 and a second branch 248. The first branch 246 connects the second oil separator 235 to the first side 223 of the suction line 220 through the first capillary tube 252. The second branch 248 connects the second oil separator 235 to the second side 225 of the suction line 220 through the third capillary tube 256.

Any oil that is discharged from compressor A 210 passes through the first oil separator 233 to a first oil return line 242. The oil is metered through the second capillary tube 254 and enters the second side of the low-pressure suction line 225. If both compressor A 210 and compressor B 215 are operating, the second side of the suction line 225 will supply low-pressure refrigerant and oil to compressor B 215 and the first side of the suction line 223 will supply low-pressure refrigerant and oil to compressor A 210. If only compressor A 210 is operating and compressor B 215 is off, any oil that enters either the first side 225 or second side 225 of the suction line 220 will be pulled to compressor A 210. When both compressor A 210 and compressor B 215 are operating, oil that passes through the second capillary tube 254 will pass through the second side of the suction line 225 and enter compressor B 215.

Any oil that is discharged from compressor B 215 passes through the second oil separator 235 to the second oil return line 244. A portion of the oil that enters the second oil return line 244 will pass through the first branch of the second oil return line 246 while the remaining oil that enters the second oil return line 244 will pass through the second branch of the second oil return line 248. The first branch 246 connects the second oil return line 244 to the first side of the suction line 223 through the first capillary tube 252. The second branch 248 connects the second oil return line 244 to the second side of the suction line 225 through the third capillary tube 256.

The amount of oil that passes through a capillary tube is determined by the size of the capillary tube. The sizing of a capillary tube can be used to control the flow rate and pressure drop of a fluid passing through the capillary.

In balanced operation, the amount of oil that is returned to compressor A 210 is substantially similar to the amount of oil discharged by compressor A 210. The first capillary tube 252 is selected to provide the desired amount of oil from the second oil separator 235 to the first side of the suction line 223 and ultimately to compressor A 210. The desired amount of oil is identified based on the specifications of the compressor such as, for example, compressor size, flow rate, or configuration.

The second capillary tube 254 is selected to provide the same or a substantially similar amount of oil as the first capillary tube 252. The second capillary tube 254 provides oil from the first oil separator 233 to the second side of the suction line 225. When compressor B 215 is operating, this oil passes through the second side of the suction line 225 to compressor B 215. When compressor B 215 is not operating, the oil is pulled from the second side of the suction line 225 to the first side of the suction line 223 and into compressor A 210. When compressor B 215 is not operating, compressor A 210 and the first oil return line 242 create a self-circulation path so that the oil that is discharged by compressor A 210 is returned to compressor A 210.

Figure 3:
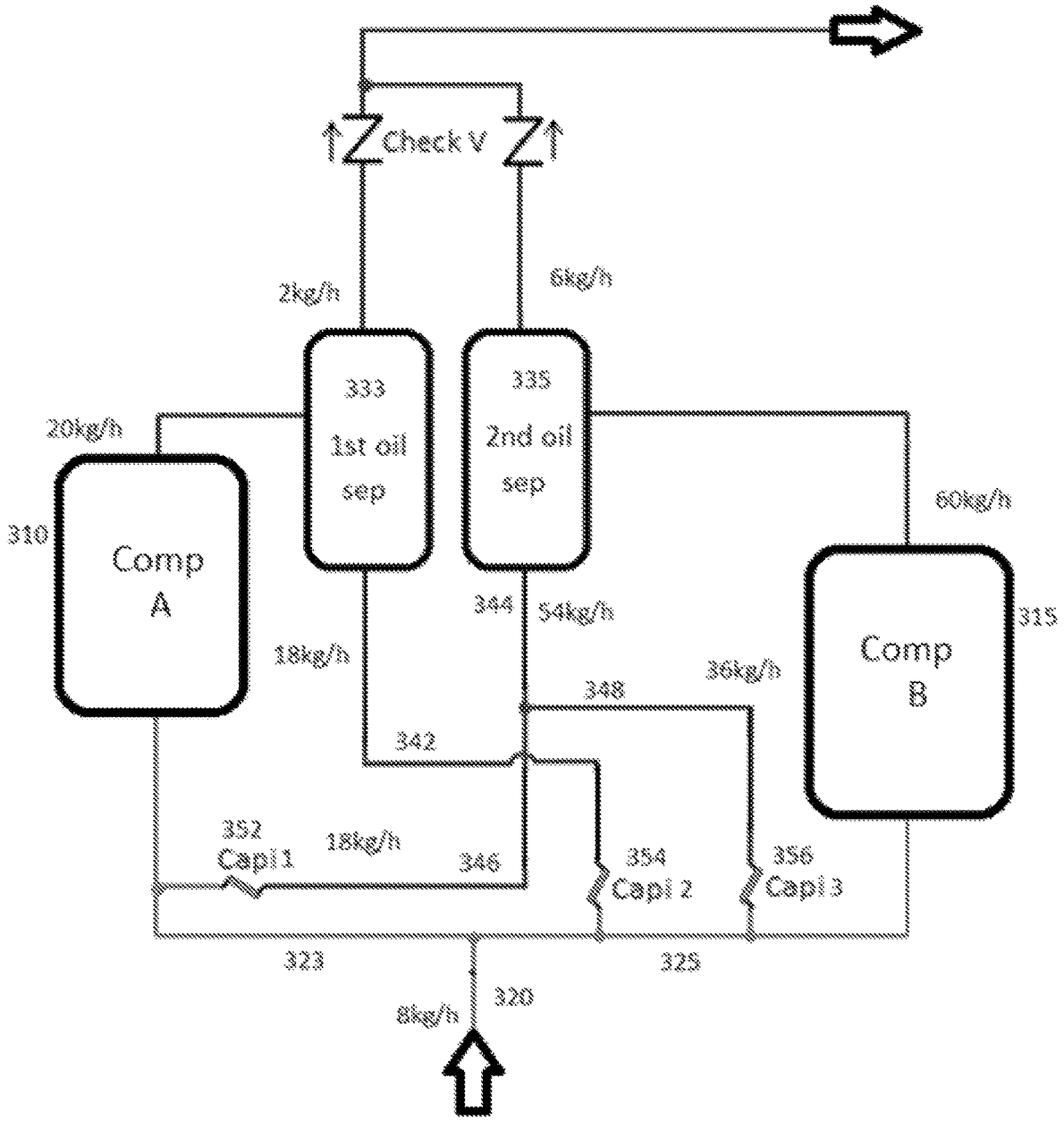
FIG. 3 illustrates schematically a specific embodiment of an HVAC system in accordance with the present disclosure.

FIG. 3 illustrates a specific example embodiment in accordance with the present disclosure. In the embodiment illustrated in FIG. 3, compressor A 310 discharges oil at a rate of 20 kg/h. This oil is separated from the high-pressure refrigerant by the first oil separator 333. The first oil separator 333 captures 18 kg/h of oil and discharges 2 kg/h of oil with the high-pressure refrigerant. The 18 kg/h of oil that is captured by the first oil separator 333 is sent through the first oil return line 342 and through the second capillary tube 254 to the second side of the suction line 325. In this particular embodiment, compressor B 315 discharges 60 kg/h of oil with the high-pressure refrigerant. The second oil separator 335 captures 54 kg/h and discharges 6 kg/h with the high-pressure refrigerant. The 54 kg/h of oil that is captures is sent to the second oil return line 344. The first branch 346 of the second oil return line carries 18 kg/h through the first capillary tube 352 to the first side of the suction line 223. The second branch 348 of the second oil return line carries 36 kg/h of oil through the third capillary tube 356 into the second side of the suction line 325. A total of 8 kg/h is discharged from the two oil separators and circulates with the high-pressure refrigerant until the entrained oil is ultimately returned through the suction line 320 to the compressors. It will be appreciated that the larger compressor B will draw a larger amount of the 8 kg/h of oil supplied through the suction line than the smaller compressor A. This proportion is substantially equal to the proportion at which each compressor loses oil from the first or second oil separator. In the embodiment illustrated in FIG. 3, 2 kg/h flow from the suction line 320 into the first side of the suction line 333 and 6 kg/h flow to the second side of the suction line 325.

As shown in FIG. 3, the amount of oil that passes through the first capillary tube to the first side of the suction line 323 is substantially the same as the amount of oil that passes through the second capillary tube to the second side of the suction line 325. The third capillary tube is configured to allow 36 kg/h to pass from the second branch 348 of the second oil return line to the second side of the suction line 325.

When both compressors A and B are in operation, this configuration supplies 18 kg/h of oil from the second oil separator 335 to compressor A 310. This configuration supplies 18 kg/h of oil from the first oil separator 333 and 36 kg/h of oil from the second oil separator 335 to compressor B 315.

If compressor B is deactivated, it will stop discharging oil to the second oil separator 335. In this situation, the 18 kg/h of oil that is discharged from the first oil separator 333 to the second side of the suction line 325 will be drawn back through the first side of the suction line 323 to compressor A 310. Whether compressor B is operating or not, this disclosed configuration supplies a balanced 18 kg/h of oil to compressor A. It will be appreciated that during the activation and/or deactivation of compressor B, there may be temporary disruptions to flow of oil until the system rebalances.

Figure 4:
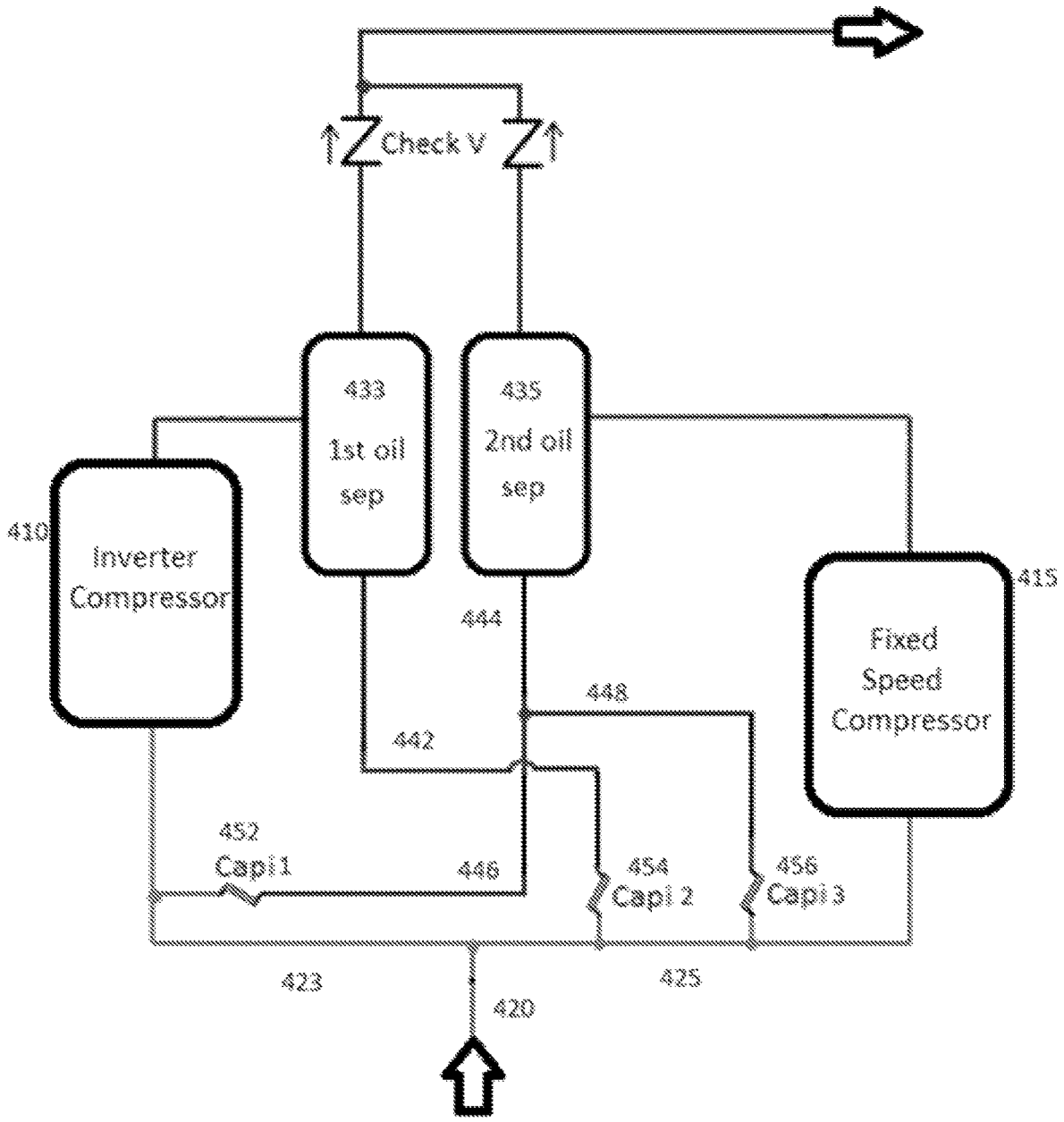
FIG. 4 illustrates schematically an HVAC system with an inverter compressor and a fixed speed compressor in accordance with the present disclosure.

FIG. 4 illustrates schematically an embodiment according to the present disclosure. As shown in FIG. 4, in some embodiments, compressor A may be a variable speed inverter compressor while compressor B is a fixed speed compressor. If compressors A and B are sized in a particular manner, the combination of one variable speed compressor with a similarly sized fixed speed compressor can create substantially any flow rate ranging from the lowest flow rate possible with only the inverter compressor to the combined total of the maximum output of the variable compressor and the fixed speed compressor.

Figure 5:
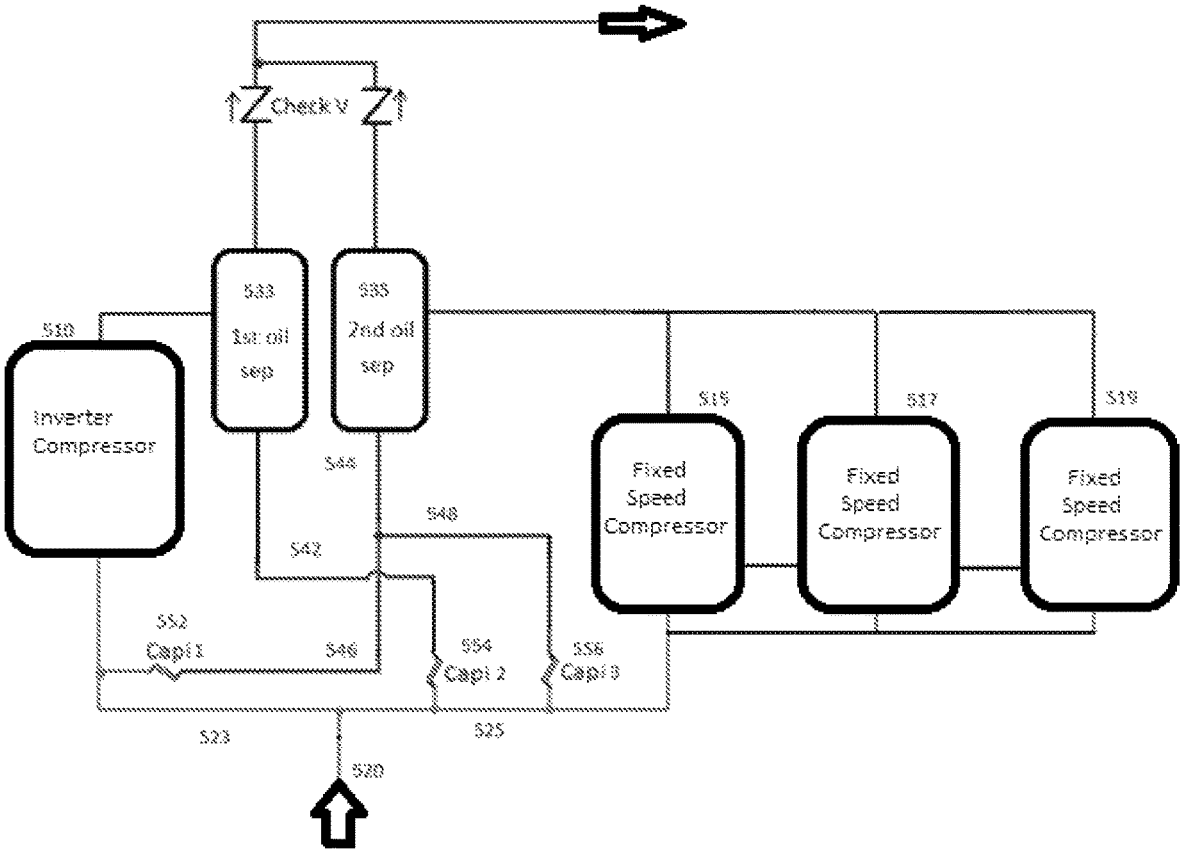
FIG. 5 illustrates schematically an HVAC system with an inverter compressor and multiple fixed speed compressors in accordance with the present disclosure.

FIG. 5 illustrates schematically an embodiment in which compressor B includes multiple fixed speed compressors. In some embodiments, each fixed speed compressor may be activated or deactivated in order to produce the desired refrigerant flow in the system as a whole. In some embodiments, each fixed speed compressor discharges high-pressure refrigerant and any entrained oil to the second oil separator 535. Each fixed-speed compressor may also be connected to the second side of the suction line 525. Accordingly, the operating principles that lead to a balanced oil carryover discussed herein can apply equally to embodiments using a single fixed speed compressor and embodiments using multiple fixed speed compressors.

Depending on the sizing of the fixed speed compressors and the inverter compressors, a wide range of flow rates can be generated using such an arrangement. Depending on the circumstances, the range of flow rates could be from the minimum flow generated by only the inverter compressor to the maximum flow generated by the inverter compressor and all of the fixed speed compressors combined.

While the general concept of the disclosed compressor oil return system has been discussed in the context of a few particular embodiments, it will be appreciated that many variations are contemplated.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An HVAC system comprising:

one or more inverter compressors in fluid communication with a first oil separator;

one or more fixed speed compressors in fluid communication with a second oil separator;

a suction line having a first side and second side, wherein the first side of the suction line is configured to supply refrigerant to the one or more inverter compressors and the second side of the suction line is configured to supply refrigerant to the one or more fixed speed compressors;

a first oil return line configured to transfer oil from the first oil separator to the second side of the suction line;

a second oil return line wherein the second oil return line is divided to transfer oil from the second oil separator to both the first side and second side of the suction line and;

wherein the second oil return line comprises a first branch configured to transfer oil from the second oil return line to the first side of the suction line and a second branch configured to transfer oil from the second oil return line to the second side of the suction line.

2. The HVAC system of claim 1, further comprising a first capillary tube in fluid communication with the first branch of the second oil return line, a second capillary tube in fluid communication with the first oil return line, and a third capillary tube in fluid communication with the second branch of the second oil return line.

3. The HVAC system of claim 2, wherein the first capillary tube and the second capillary tube are configured to allow a similar flow of the oil to pass through.

4. The HVAC system of claim 2 wherein the third capillary tube is configured to allow a greater flow of the oil to pass through compared to the first capillary tube or the second capillary tube.

5. The HVAC system of claim 1, further comprising at least two fixed speed compressors in fluid communication with the second oil separator.

6. The HVAC system of claim 1, further comprising one inverter compressor.

7. The HVAC system of claim 1, wherein the one or more inverter compressors have a lower oil carryover than the one or more fixed speed compressors.

8. The HVAC system of claim 1, further comprising a compressor oil selected from the group consisting of Polyalkylene Glycol (PAG), Polyolester (POE), Mineral Oil, Alkylbenzene (AB), Polyvinyl Ether (PVE), and R-1234yf Oil.

9. An oil return system for a plurality of HVAC compressors comprising:

a low-pressure refrigerant line having a first portion and a second portion, the first and second portions of the low-pressure refrigerant line extending in different directions from a refrigerant inlet point;

a first oil discharge line fluidly connecting a first compressor to a first oil separator;

a first oil return line connecting the first oil separator to the second portion of the low-pressure refrigerant line through a second capillary tube;

a second oil discharge line fluidly connecting a second compressor to a second oil separator, wherein the second compressor has a larger oil carryover than the first compressor;

a second oil return line connecting the second oil separator to the first portion of the low-pressure refrigerant line through a first capillary tube and connecting the second oil separator to the second portion of the low-pressure refrigerant line through a third capillary tube, wherein the first capillary tube and the second capillary tube are configured to allow similar amounts of oil to flow through and wherein the third capillary tube is configured to allow more oil to flow through with respect to the first capillary tube and the second capillary tube.

10. The oil return system of claim 9, wherein the first compressor comprises an inverter compressor and the second compressor comprises at least two fixed speed compressors in fluid communication with the second oil separator.

11. The oil return system of claim 9, wherein the first compressor has a lower oil carryover than the second compressor.

12. The oil return system of claim 9, further comprising a compressor oil selected from the group consisting of Polyalkylene Glycol (PAG), Polyolester (POE), Mineral Oil, Alkylbenzene (AB), Polyvinyl Ether (PVE), and R-1234yf Oil.

* * * * *